US010859243B2

(12) United States Patent
Simmons, Jr. et al.

(10) Patent No.: US 10,859,243 B2
(45) Date of Patent: Dec. 8, 2020

(54) MODULAR RECESSED LIGHT SYSTEM

(71) Applicant: Pathway Lighting Products, Inc., Old Saybrook, CT (US)

(72) Inventors: Donald K. Simmons, Jr., Ivoryton, CT (US); Nicholas P. Banker, North Stonington, CT (US); Phillipp T. Aubé, Groton, CT (US); Todd A. Guertin, Norwich, CT (US)

(73) Assignee: Pathway Lighting Products, Inc., Old Saybrook, CT (US)

( * ) Notice: Subject to any disclaimer, the term of this patent is extended or adjusted under 35 U.S.C. 154(b) by 58 days.

(21) Appl. No.: 16/184,102

(22) Filed: Nov. 8, 2018

(65) Prior Publication Data

US 2020/0149717 A1 May 14, 2020

(51) Int. Cl.
*F21V 21/04* (2006.01)
*F21S 8/02* (2006.01)

(52) U.S. Cl.
CPC ..... *F21V 21/049* (2013.01); *F21S 8/026* (2013.01); *F21V 21/047* (2013.01)

(58) Field of Classification Search
CPC ..... F21V 21/049; F21V 21/047; F21S 8/026
See application file for complete search history.

(56) References Cited

U.S. PATENT DOCUMENTS

| | | | | |
|---|---|---|---|---|
| 6,082,878 | A * | 7/2000 | Doubek | F21S 8/026 211/26 |
| 10,274,183 | B2 * | 4/2019 | Randolph | F21K 9/00 |
| 10,488,000 | B2 * | 11/2019 | Danesh | F21S 8/03 |
| 10,551,044 | B2 * | 2/2020 | Peng | F21S 8/02 |
| 2013/0051012 | A1 * | 2/2013 | Oehle | F21S 8/026 362/235 |
| 2017/0167672 | A1 * | 6/2017 | Stauner | F21S 8/026 |

* cited by examiner

*Primary Examiner* — Mary Ellen Bowman
(74) *Attorney, Agent, or Firm* — Alix, Yale & Ristas, LLP

(57) ABSTRACT

A modular recessed light system employs a frame which secures a mounting ring on one side of a ceiling opening and receives a ceiling collar with a circumferential flange on the other side of the ceiling opening. The mounting ring and the ceiling collar are clamped to opposing sides surrounding the ceiling opening. The collar mounts a pair of clamp members which engage slots of a light module which is insertable into the ceiling opening and retained in recessed relationship with the ceiling. The light module may be a down light module or an angularly adjustable light module. In addition, a trim assembly, which may have a square trim with a down light lens, a square trim with an angled lens, a circular trim with a down light lens or a circular flange with an angled lens are also each releasably retained to the housing by magnetic bonding. A mud or plaster ring may also be optionally mounted over the circumferential flange of the ceiling collar and secured to the mounting ring.

20 Claims, 9 Drawing Sheets

MODULAR RECESSED LIGHT SYSTEM

BACKGROUND

This disclosure relates generally to recessed ceiling lights and mounting systems therefor. More particularly, this disclosure relates to ceiling lights which provide a wall wash, a down light or an adjustable light of various forms.

Numerous recessed ceiling lights which employ a frame that receives a light module have been proposed. The installation typically involves mounting a frame to the upper surface of the ceiling or to the ceiling support structures and providing a ceiling opening. A light module is then affixed to the frame above the opening. The frames are typically configured to the specific light module in terms of function, shape and trim features, as well as the finishing characteristics of the ceiling, such as a mud-in or plastic ceiling fixture or a smooth ceiling feature.

In conventional recessed light systems to which the present disclosure addresses, access to the recessed light after the frame installation can be problematic. Furthermore, each frame tends to be configured for a specific light module model. Each frame tends to be matched with a specific trim shape or configuration. Typically, the frame also requires selection in accordance with whether a smooth surface fixture or a mud-in fixture is desired for the ceiling finish.

After installation, access to the recessed light for maintenance and replacement is highly desired. Typically, the installation and/or maintenance of the recessed light requires tools to remove and replace the light module or the lighting fixture.

In addition, for some recessed ceiling light systems, light leakage through the light fixture is common due to the dimensional variances and incompatibilities between the various components.

An additional aesthetic and sometimes even functional issue that occurs with ceiling mount fixtures results from the movement of the ceiling over time. In this regard, it is highly desirable to provide a recessed ceiling mount fixture so that each recessed light module effectively moves in concert with any ceiling movement.

SUMMARY

A recessed light assembly comprises a frame comprising a mounting bracket extending from a base having an opening. The frame mounts a ring securable to the base. A sealing collar comprises a sleeve and has a circumferential rim. The ceiling collar is cooperatively clampable with the mounting ring to form an access opening. A light module comprises a housing and is insertable through the access opening. The housing is releasably engageable with the retainer collar to support the light module in recessed relationship. A trim covers the circumferential rim and is releasably retainable with the housing.

The ring has angularly spaced threaded bores. A pair of threaded fasteners is extendable through the ceiling collar and secured in the threaded bores. The sleeve mounts a pair of inwardly biased clamping members. The housing defines a pair of slots which releasably receive the clamping members. The trim mounts at least one magnet and the housing mounts at least one magnet. The trim is releasably retainable with the housing by means of magnetic bonding.

The trim is selectable from numerous configurations including a square down light lens assembly, a circular down light lens assembly, a square wall wash lens assembly and a circular wall wash lens assembly. A plurality of reflectors are each removably insertable into the housing.

The frame further has a pair of clips mounted to opposed locations relative to the frame opening. The mounting ring is supportable by the clips at a retracted position spaced from the base and is securable by the clips at a second position against the base. The light module may be a down light module or an angularly adjustable light module.

A mud ring may be optionally disposed adjacent the circumferential rim. Fasteners secure the mud ring to the mounting ring. A key facilitates proper angular alignment of the mud ring.

In one embodiment, the trim comprises four angularly spaced magnets and the housing mounts four angularly spaced magnets which axially align with the trim magnets and magnetically bond therewith. The trim comprises a pedestal extending from a flange and a lens mounted to the pedestal. The pedestal defines a central optical axis and the lens is disposed orthogonally to the optical axis or at an acute angle to the optical axis. The trim and the ceiling collar have an engageable key and keyway to angularly align the trim relative to the frame.

In another embodiment, a recessed light assembly comprises a frame which has a panel with an opening. A pair of clips is mounted to the panel. A ring is supported on the panel and secured to the panel by clips. The ring has angularly spaced threaded bores. A ceiling collar comprises a sleeve and a circumferential rim. Threaded fasteners extend from the ceiling collar and are securable in the bores of the ring to cooperatively clamp the ceiling collar with the ring. The sleeve defines an access opening and has a pair of inwardly biased clamps. A light module is insertable through the access opening. The light module has a housing which is engageable by the clamps to support the light module on the collar. The housing is also releasable from the clamps and withdrawable from the access opening. A trim is mountable over the circumferential rim and releasably retainable by magnetically bonding with the housing.

The light module is a down light module or an angularly adjustable light module. The trim may be an assembly comprising a square border with a down light lens, a square border with an angled lens, a circular border with a down light lens or a circular border with an angled lens.

A recessed light assembly installation comprises a ceiling having a lower surface and an upper surface and a ceiling opening extending through the lower and the upper surface. A frame has a panel disposed on the upper surface and a pair of clips mounted to the panel. A ring is supported on the panel and secured by the clips. The ring has angularly spaced bores and generally aligns with the ceiling opening. A ceiling collar comprises a sleeve with a circumferential rim. Threaded fasteners are secured in the bores to cooperatively clamp the collar to the ring so that the ring clamps against the upper surface and the rim clamps against the lower surface. The sleeve mounts a pair of inwardly biased clamps and forms an access opening coaxial with the ceiling opening, the ceiling collar and the ring. The light module comprises a housing having a pair of slots which are engaged by the clamps to releasably support the light module in recessed relationship relative to the ceiling.

The mounting ring further has fastener openings. A mud ring may be mounted over the circumferential rim and engage the ceiling. Fasteners extend through the mud ring and the ceiling and engage the fastener openings in the mounting ring. A trim assembly is mounted over the mud ring and releasably retainable with the housing. The light module can be either a down light module or an angularly adjustable light module. The trim assembly can comprise a square flange with a down light lens, a square flange with an angled lens, a circular flange with a down light lens or a square flange with an angled lens.

DETAILED DESCRIPTION

Figure 1:
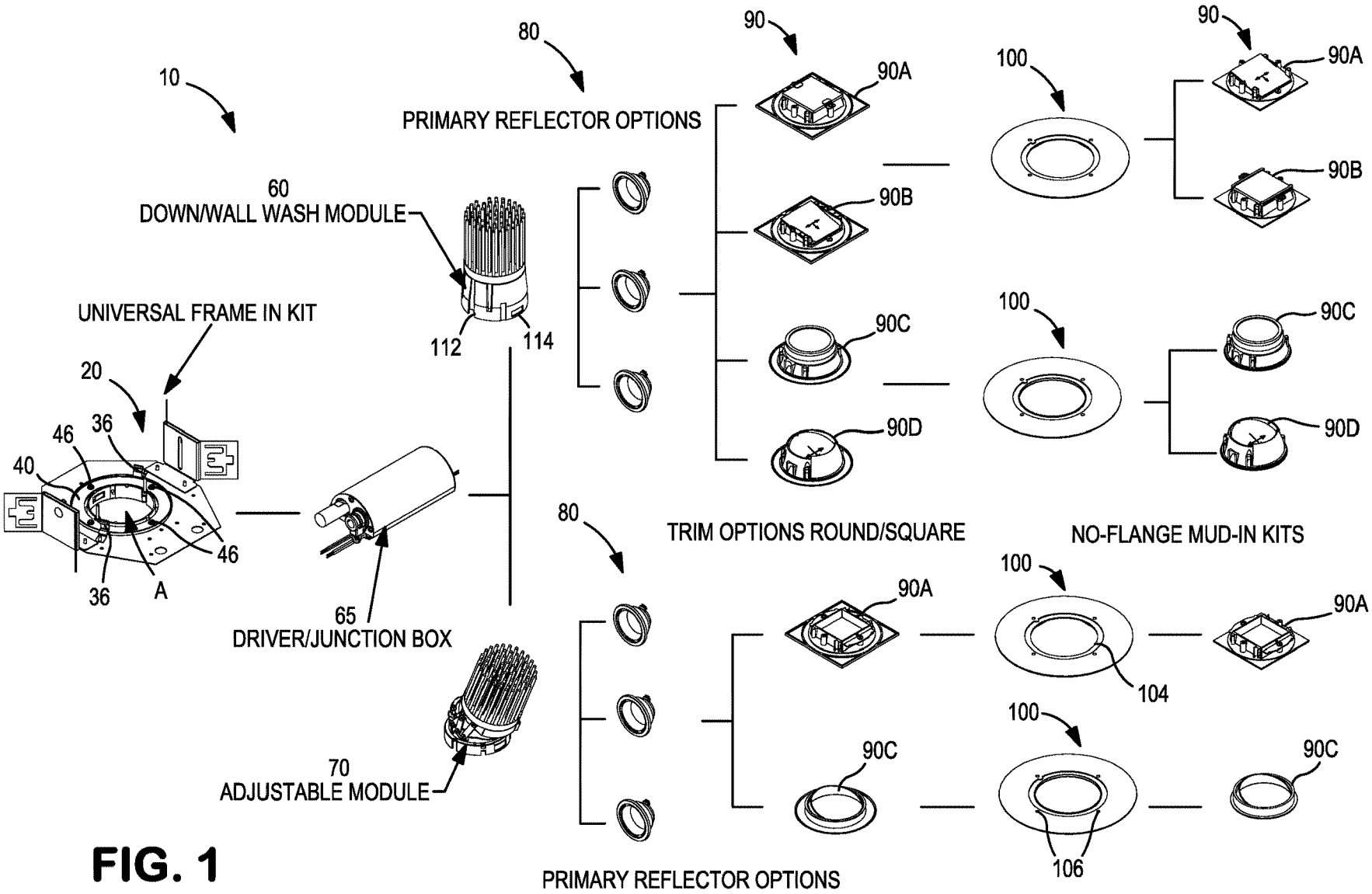
FIG. 1 is a schematic diagrammatic view, partly annotated, illustrating modular features of a modular recessed light system.
Figure 2:
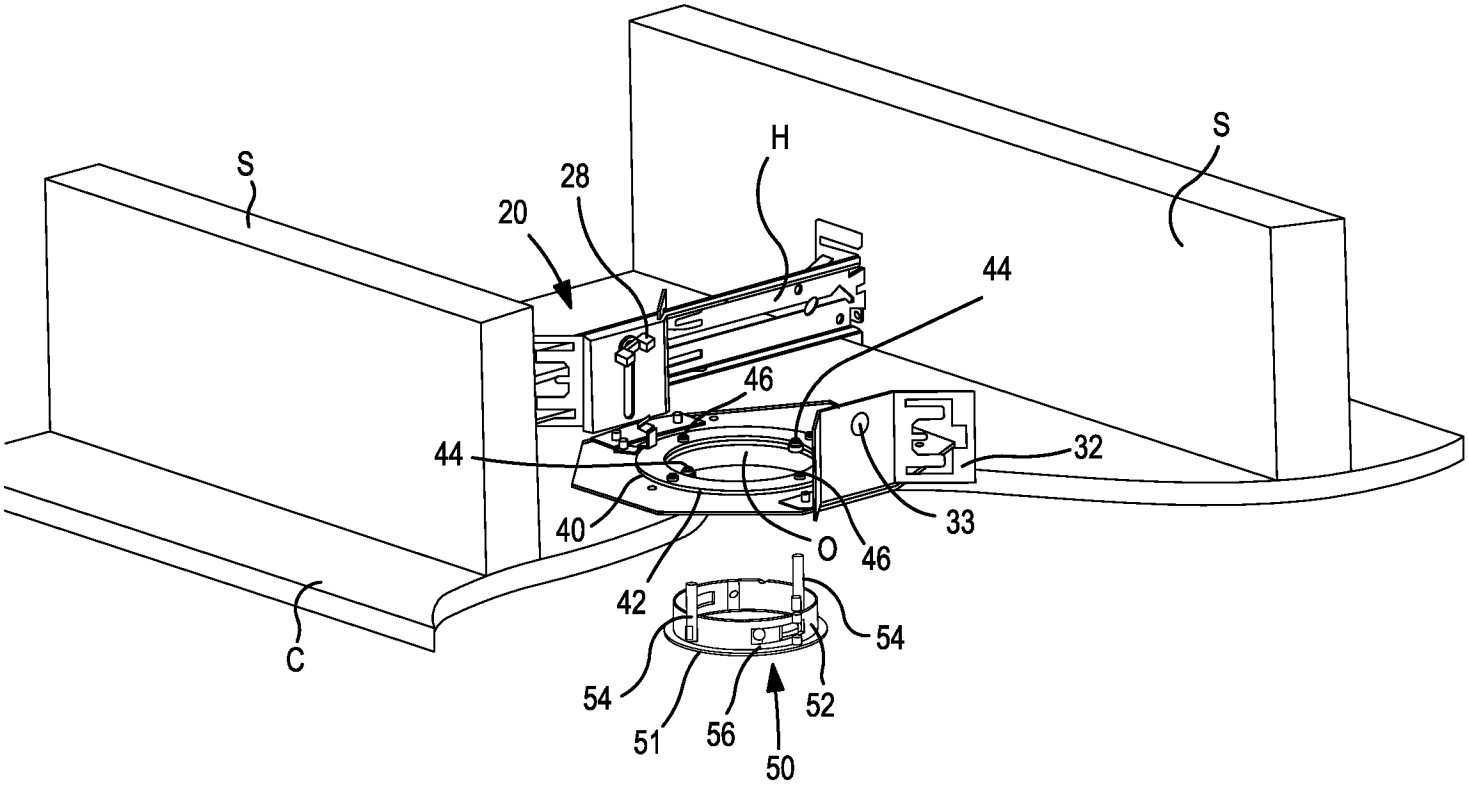
FIG. 2 is a cutaway perspective view of a representative ceiling and a frame mounted to the ceiling with a collar being illustrated prior to installation.
Figure 3:
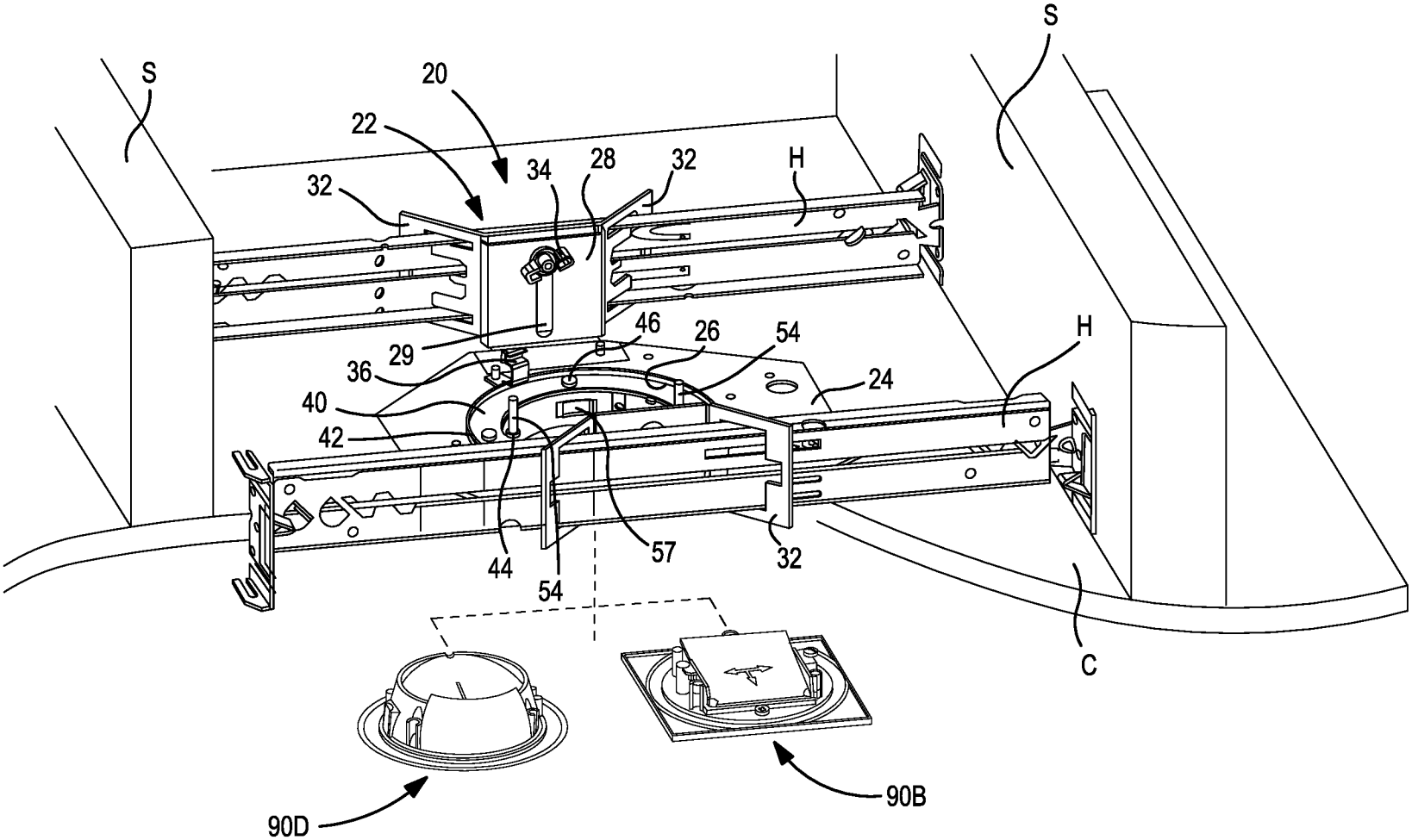
FIG. 3 is a cutaway perspective view, partly exploded and diagrammatic, of the installed components of FIG. 2 and further illustrating how the recessed fixture can be converted from down light to wall wash light by simply changing various trim assemblies which are illustrated in perspective.

With reference to the drawings wherein like numerals represent like parts throughout the figures, a modular recessed light system, which is generally designated by the numeral 10, is schematically and diagrammatically illustrated in FIG. 1. The illustrated modular recessed system 10 is suggestive for a given light module or aperture dimension and does not illustrate all of the modular capabilities.

The modular recessed light system 10 mounts to the ceiling structure which may include the upper surface of a ceiling C or a ceiling support structure S disposed above a ceiling opening O. In one preferred embodiment, the modular recessed light system is adapted for the standard openings formed by a Lenox™ 3⅛ inch diameter hole saw.

A universal frame-in-kit 20 is adapted to be fixedly mounted and to receive either a down/wall wash module 60 or an adjustable module 70. The adjustable light module 70 may be adjusted to adjust the angle at which the light is projected so as to direct light to a selected location or object. The angle adjustment is typically made with the use of a Philips screwdriver to set and secure a desired fixed angle for the emitted light. Each of the down/wall wash module and the adjustable module receives a selected primary reflector option 80. In addition, each of the primary reflector options may be considered with selected round/square and down/wall wash trim options 90. The universal frame-in-kit 20 is further adapted to couple with a no flange plaster mud-in kit 100 which also receives various trim options 90. Each of the modules 60 and 70 is connectable with a common driver/junction box 65.

It will be appreciated that each frame-in-kit 20 is universal (for a given aperture dimension) and can be shipped prior to installation to the ceiling structure. A universal feature of the frame-in-kit resides in the ability to accept either a down/wash light module or an adjustable light module. In addition, various reflector options 80 and trim options 90, including round or square trim options, may be suitably selected and efficiently installed in place without the requirement of tools. The universal frame-in-kit 20 is configured so that down lights, wall wash and adjustable light modules will all be accommodated by the same universal frame-in-kit. It will also be appreciated that the recessed light optics are field selectable and interchangeable post installation.

The frame-in-kit 20 includes a frame 22 with a panel-like base or pan 24 which defines a circular opening 26. A pair of L-shaped connectors 28 extend upwardly from the base and are each secured to the base by a pair of fasteners extending through an integral connector flange. Each connector mounts a bracket 30 with spaced angled wings 32 which extend from a medial panel 31. The frame 22 is fixed relative to the ceiling structure with the opening of the frame aligning with the ceiling opening O. Fasteners, brackets and/or adhesives may be employed to attach the frame 22 via hangers H to the ceiling structure S through the brackets 30. Each connector 28 defines a vertical slot 29 which receives a bolt 33 traversing an opening in the medial panel 31. A thumb knob 34 adjustably secures the spacing of each bracket from the base 24. The base 24 is lowered or positioned by the bolt 33 sliding down the slot 29. When the base 24 engages the upper surface of the ceiling C, the thumb knobs 34 are tightened in place.

Two multi-bent metal clips 36 are located at diametrically opposed positions from the opening 26 and are each secured to the frame base 24 by a fastener. The clips 36 initially resiliently engage a mounting ring 40 having a circumferential rim 42 at a position spaced above the pan or base and the opening O. Once the frame is secured in position, the installer reaches upwardly through the opening O. The installer pulls the mounting ring 40 downwardly so it rests on the frame and is clamped by the lower clip sections against the pan or base. The mounting ring now surrounds the opening O and engages the adjacent upper ceiling surface edge. The mounting ring 40 has two inwardly projecting threaded sockets 44 at diametrically opposed locations. The mounting ring 40 has an inner diameter substantially equal to the diameter of the opening O. The ring 40 also has four angularly spaced threaded bores 46.

A ceiling collar 50 receivable in the opening O has a lower circumferential annular rim or flange 51 extending from a shallow or truncated cylindrical sleeve 52. The sleeve 52 is insertable into the opening O from the underside of the ceiling. The flange 51 engages against the ceiling surface adjacent the opening O. A pair of diametrically opposed elongated threaded fasteners 54 extend upwardly from the collar and thread through the sockets 44 of the mounting ring 40 to secure the ceiling collar in position. The annular flange 51 is now clamped to ring 40 on opposite sides of the ceiling C and defines a central access opening A for a light module 60 or 70. The lengths of the fasteners are sufficient to accommodate a significant range of ceiling thicknesses. The sleeve 52 has a pair of opposed recesses 56 which each receive an inwardly biased clamp 57.

The ceiling collar 50 via opening A receives either a down light module 60 or an angularly adjustable light module 70. The modules include a housing 110 which houses the lighting components such as, for example, light emitting diodes (LED) or similar units and a circuit board (PCB) (neither illustrated). A heat sink unit 120 is mounted above the housing. The heat sink at the upper region of the module assists in the heat dissipation from the light module. Modules 60 and 70 also receive a selected reflector 80. The various selected reflector options 80 may be inserted into the light modules prior to mounting to the collar and may also easily be removed post-installation.

Prior to mounting the light modules 60 or 70, the driver/junction box 65 may be inserted through the access opening A, and ultimately efficiently connected with the light module 60 or 70.

Figure 4:
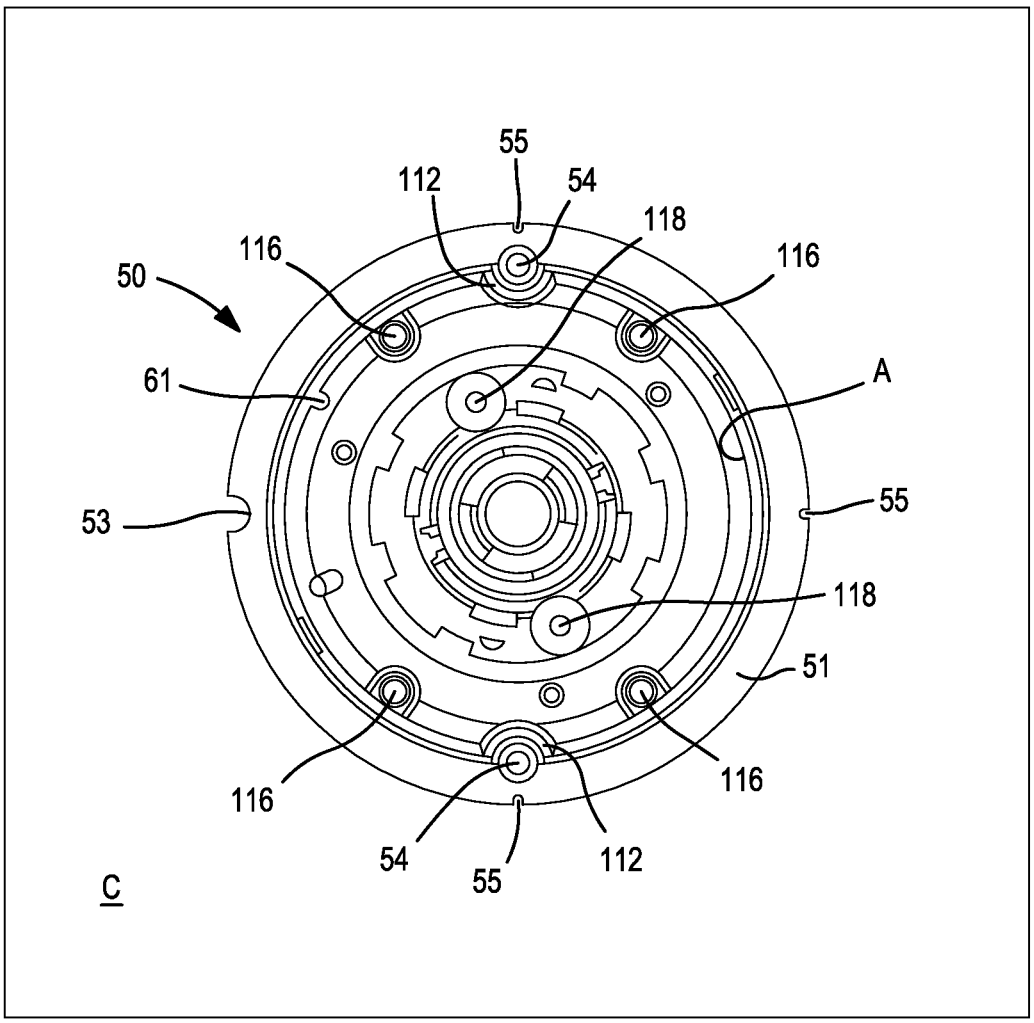
FIG. 4 is a bottom plan view of the installation of FIG. 3 after a light module has been mounted in recessed relationship to the installation.

With additional reference to FIG. 4, the light modules 60 and 70 each has a quasi-cylindrical housing 110 which has a diameter slightly less than the diameter of the access opening A. The housing exteriorly forms a pair of slightly inclined diametrically opposed recesses 112 which provide clearance for the inwardly protruding sockets 44. Two aligned diametrically opposed slots 114 are defined in the lower side portion of the housing. The slots 114 preferably have a shape complementary to that of the engaging surfaces of the clamps 57 of the ceiling collar, but are slightly larger. The slots 114 are equidistantly angularly spaced from the clearance recesses 112. The housing also forms four sleeve-like inwardly protruding bosses which receive, at the lower end portions, 4 mm cylindrically shaped magnets 116 (FIG. 4). The magnets 116 may be glued into position. Fasteners 118 secure the housing to the heat sink unit 120. The housing 110 effectively functions as a light shield so that stray light is not dispersed above the ceiling. The periphery of the lower end of the housing defines a keyway for the round trim, as will be further described.

With reference to FIG. 4, the periphery of flange 51 defines a master notch 53 which functions as a keyway for angularly aligning the square trim (as described below) and 90° angularly spaced alignment notches 55 which function as a guide for aligning the collar 50 relative of the frame.

Figure 6:
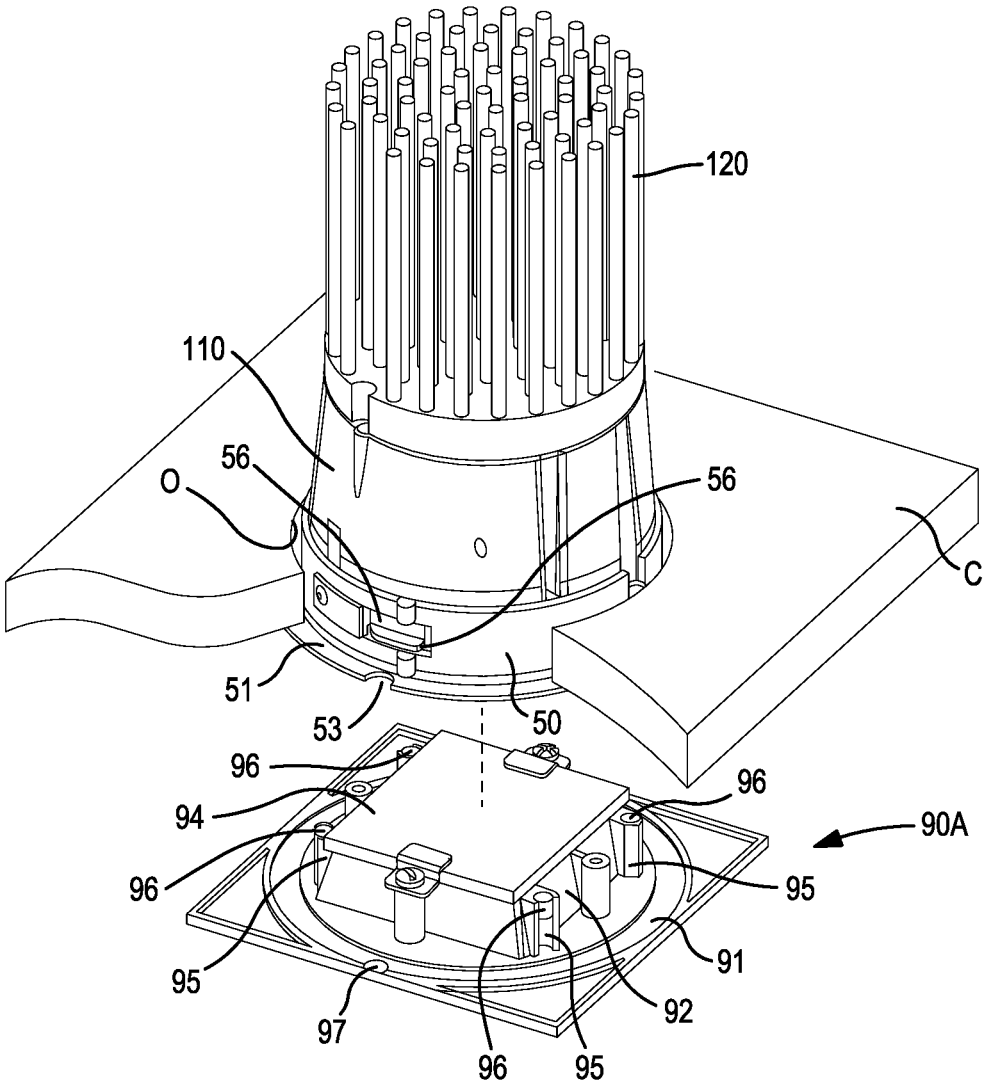
FIG. 6 is an enlarged cutaway perspective view, partly exploded, of a representative ceiling, a light module mounted to the ceiling collar and a representative square trim prior to mounting further illustrating an alignment notch and a tab for aligning the trim.

With additional reference to FIG. 6, trim 90A provides a square border and is insertable into the housing 110 over the flange 51 to thereby engage the ceiling C with an exposed exterior square flange 93 surrounding the light output aperture. Trim 90A has an annular recess 91 complementary to flange 51. A pedestal 92 mounts a lens 94 spaced above the lower flange 93. Trim 90A also has a key 97 which, upon proper alignment, is inserted in notch 53. The square trim key 97 ensures the trim is properly squared relative to the frame and other components. The pedestal 92 forms a light channel having a central optical axis. The lens 94 is orthogonal to the optical axis. Four bosses 95 extend above the underside of the exterior trim surface and mount magnets 96. The magnets 96 may also be in the form of cylindrical lugs and are preferably glued in place. When the trim 90A is inserted into the sleeve, the trim magnets 96 bond with magnets 116 to releasably retain the trim 90A in position.

Trim 90B provides a square border and is similar in form and function to trim 90A, except that lens 94B is mounted to pedestal 92B at an angle (preferably 20°) to the central optical axis through the pedestal. It will be appreciated that if trim 90B is inserted into the frame/collar assembly, which receives a down light wall module 60, the recessed light fixture will be converted to function as a wall wash module.

Trim 90C has a rounded body with a circular flange 93C which forms the circular exterior trim. Trim 90C also defines a circular recess 91C complementary to the rim or flange 51 of the collar. The trim 90C has a tapered rounded pedestal 92C which mounts a circular lens 94C disposed orthogonal to the central optical axis. The trim 90C also forms a notch 97C engageable with a key 61 of the ceiling collar. The foregoing round trim keyway/key allows the trim to be properly angularly oriented relative to the frame. Four bosses 95C extend above the underside of the flange 90C and mount magnets 96. When the round trim 90C is inserted into the sleeve and angularly aligned, the magnets align and bond with the magnets 116 to releasably retain the trim 90C in position.

Figure 8:
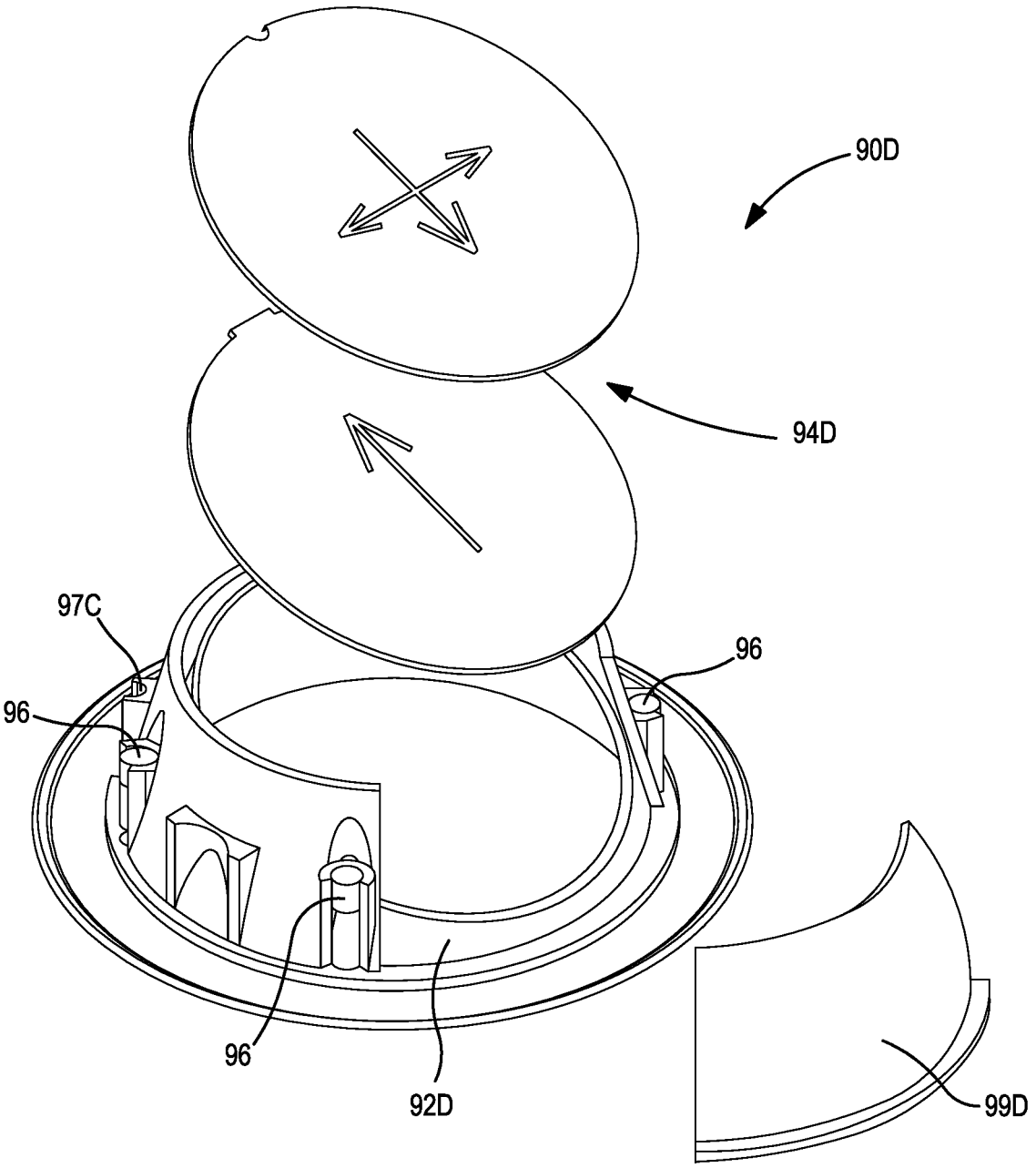
FIG. 8 is an enlarged exploded view of a round trim with a wall wash lens assembly, partly in schematic.

With reference to FIG. 8, trim 90D is substantially similar in form and function to that of round trim 90C, except that pedestal 92D is configured to mount a lens assembly 94D at an angle (preferably 20°) relative to the central optical axis through the pedestal. Lens assembly 94D preferably has a dual holographic coating of 20° and an oblong or elliptic overlay of 8° in the reverse direction to substantially uniformly distribute the light onto an adjacent wall. An arcuate light gathering kicker element 99D extends from the pedestal to divert light. Trim 90D also has a notch or keyway to properly angularly align the trim 90D with the frame. Consequently, trim 90D, upon mounting into the down light module housing 110, functions as a wall wash light when used in combination with the down light module 60. It will also be appreciated that the magnets 96 bond with the magnets 116 of the light module housing to releasably retain the trim 94D in position.

For the down/wall wash module, which may be essentially the same module 60, both square and round down and wall wash options are implemented by the selected trims 90A, 90B, 90C and 90D. For the adjustable module, both a square trim 90A and a round trim 90C option may be employed.

Figure 5:
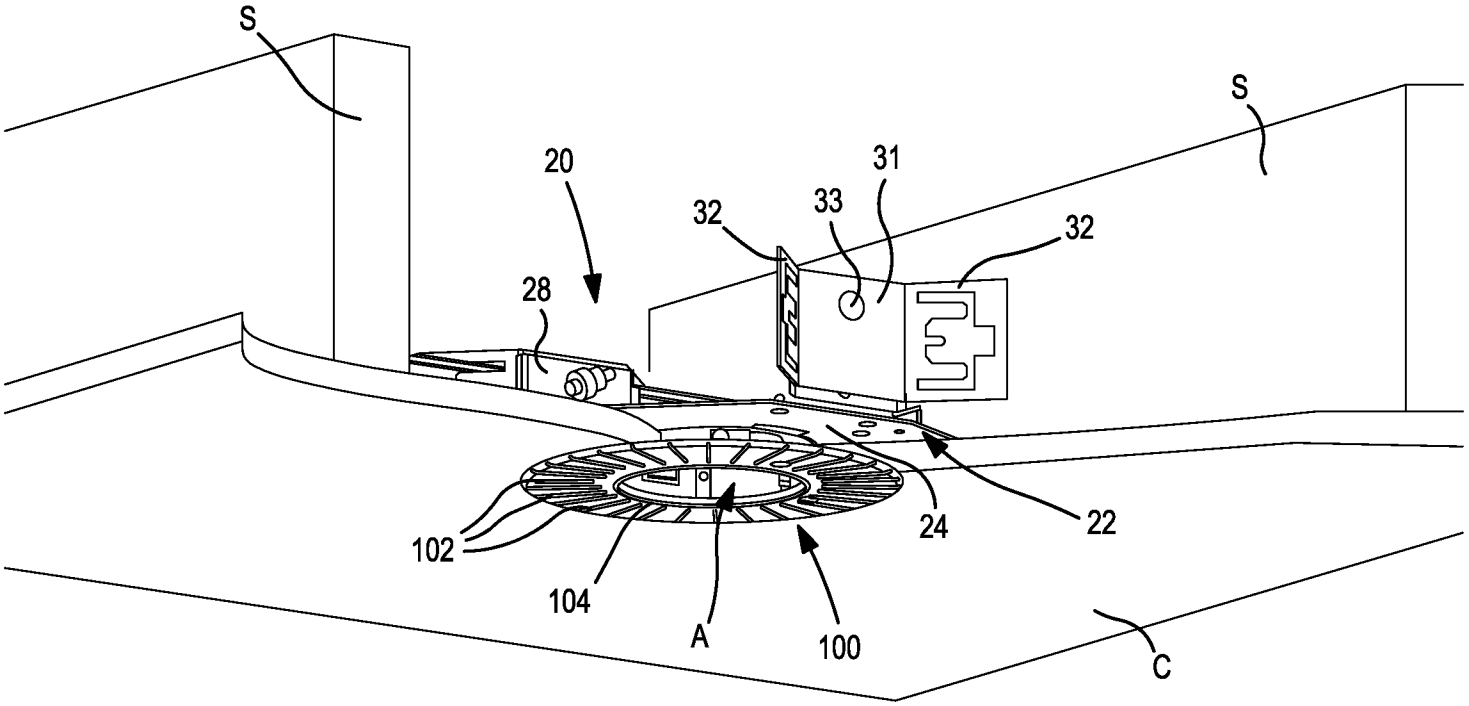
FIG. 5 is a cutaway perspective view of a representative ceiling, a frame mounted to the ceiling and a mud-in installation fixture as mounted to the frame.
Figure 7:
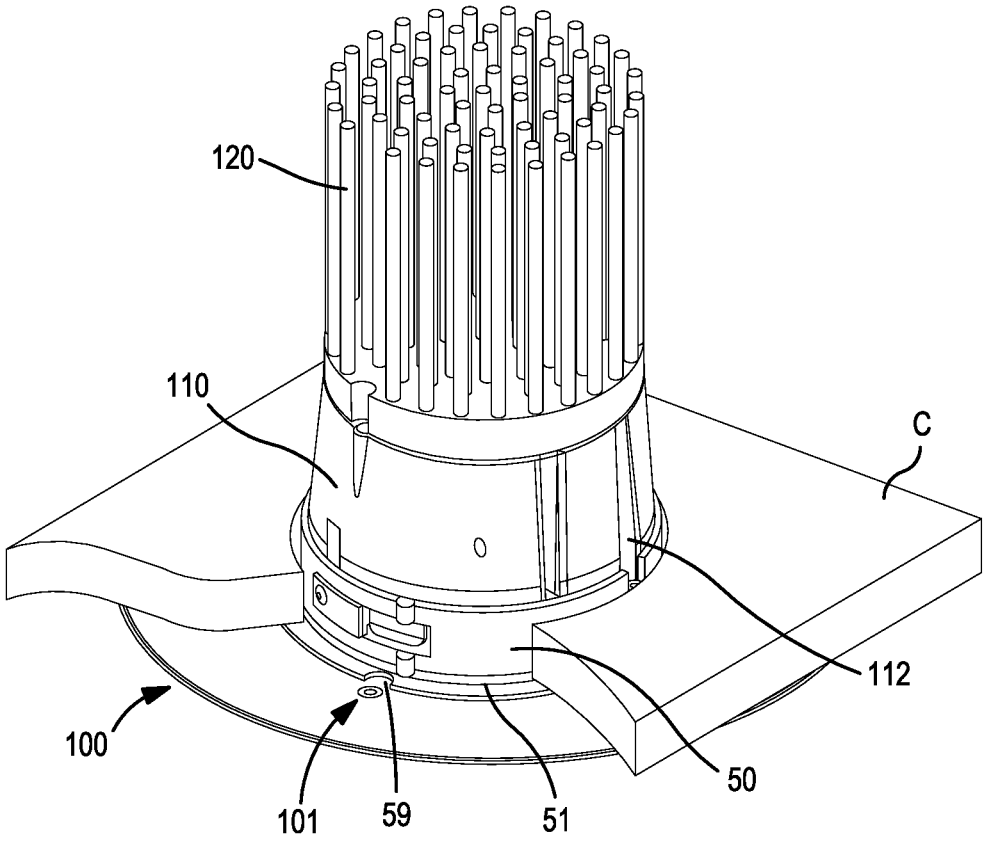
FIG. 7 is an enlarged cutaway perspective view of a representative ceiling with a light module mounted to the ceiling collar and a mounted mud-in/plaster ring further illustrating an alignment notch and tab for aligning the mud-in plaster ring.
Figure 9:
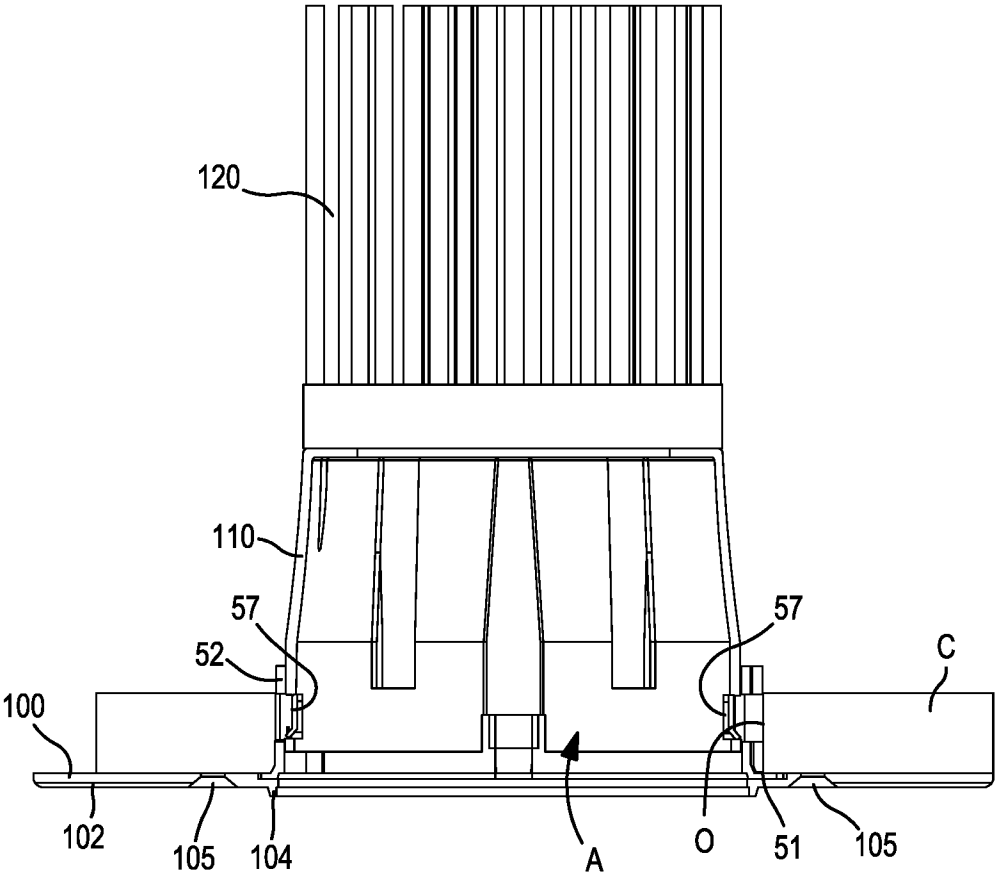
FIG. 9 is an enlarged central sectional view, portions removed, of a portion of a ceiling and a light module, collar and a mud-in ring mounted in position at a ceiling opening.

With reference to FIGS. 5 and 7, in addition to the foregoing, a mud ring kit has a plaster mud ring 100 which may be mounted over the underside of the flange of the collar. The plaster mud ring at its underside has a plurality of radial recesses 102 which facilitate a flush mud finishing of the fixture below the ceiling. An inner abbreviated annular lip 104 surrounds the access opening A. The ring has four angularly spaced openings 106 adjacent the lip 104. The plaster mud ring has a key 101 which mates with a notch or keyway 59 of the collar to angularly align the ring. Four #6 flathead fasteners 105 (FIG. 9) are driven through openings 106 through the ceiling into the bores 46 of the mounting ring to secure the mud ring in place. The trims 90A, 90B, 90C or 90D may then be inserted through the access opening A and releasably engaged with the housing 110.

Once the selected light module and selected trim are installed in position, which can essentially be done without tools (once the frame-in-kit is installed), the light module may be efficiently dismounted by removing the trim piece, e.g., pulling the trim piece downwardly, to disengage from the mounting collar and sever the magnetic bonding. The light module 60 or 70 may then be removed for maintenance and/or replaced by outwardly pushing against the clamps 57 and downwardly withdrawing the clamps and light module from the slots.

It should be appreciated that alternatives to each of the foregoing described trims 90A, 90B, 90C and 90D may take the form of substantially identical corresponding trim members except that the exterior finished surface may vary in surface materials, color and other trim characteristics.

In the alternative embodiments, magnetic bonding between the trim and the housing of the light module can be accomplished with fewer magnets than previously described. In addition, the housing and/or the trim pedestals may be formed from metal, in which case, the magnetic bonding can be accomplished by mounting magnets to either the housing or the trim.

While preferred embodiments of the foregoing modular recessed light system have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. A recessed light assembly comprising:

a frame comprising a mounting bracket extending from a base defining an opening and a mounting ring securable to the base;

a ceiling collar comprising a sleeve and having a circumferential rim cooperatively clampable with the mounting ring to form an access opening, said sleeve mounting a pair of clamping members;

a light module comprising a housing and insertable through the access opening and releasably engageable with said ceiling collar to support said light module in recessed relationship, said housing defining a pair of angularly spaced slots which releasably receive said clamping members at a fixed angular position relative to said sleeve; and a trim covering said circumferential rim and releasably retainable with said housing.

2. The recessed light assembly of claim 1 wherein said mounting ring has angularly spaced threaded bores and a pair of threaded fasteners is extendable through said ceiling collar and is securable in said threaded bores.

3. The recessed light assembly of claim 1 wherein said sleeve defines a pair of angularly spaced recesses and said pair of inwardly biased clamping members extend into said recesses.

4. The recessed light assembly of claim 1 wherein said trim mounts at least one magnet and said housing mounts at least one magnet, and said trim is releasably retainable with said housing by means of magnetic bonding.

5. The recessed light assembly of claim 1 wherein said trim is selected from the group consisting of a square down light lens assembly, a round down light lens assembly, a square wall wash lens assembly and a round wall wash lens assembly.

6. The recessed light assembly of claim 1 further comprising a reflector removably insertable into said housing.

7. The recessed light assembly of claim 1 wherein said frame further has a pair of clips mounted to said base at opposed locations relative to said opening, and said mounting ring is supportable by said clips at an elevated position spaced from said base and is securable by said clips at a second position against said base.

8. The recessed light assembly of claim 1 wherein said light module is a down light module or an angularly adjustable light module.

9. The recessed light assembly of claim 1 further comprising a mud ring disposed adjacent said circumferential rim and a plurality of fasteners securing said mud ring to said mounting ring.

10. The recessed light assembly of claim 1 wherein said trim further comprises four angularly spaced magnets and said housing mounts four angularly spaced magnets which axially align with said trim magnets and magnetically bond therewith.

11. The recessed light assembly of claim 1 wherein said trim comprises a pedestal extending from a flange and a lens mounted to said pedestal, said pedestal defining a central optical axis and said lens is disposed orthogonally to said optical axis or at an acute angle thereto.

12. The recessed lighting system of claim 1 wherein said trim and said ceiling collar have an engageable key and keyway to angularly align the trim relative to said frame.

13. A recessed light assembly comprising:

a frame having a panel defining an opening and a pair of clips mounted to said panel;

a mounting ring supported on said panel and secured thereto by said clips and defining angularly spaced threaded bores;

a ceiling collar comprising a sleeve and having a circumferential rim and a pair of threaded fasteners threadably securable in said bores to cooperatively clamp with said mounting ring, said sleeve defining an access opening and having a pair of inwardly biased clamps;

a light module insertable through said access opening and comprising a housing defining a pair of angularly spaced slots receivably engageable by said clamps to support said light module on said collar at a fixed angular position and releasable from said clamps and withdrawable from said access opening; and a trim mountable over said circumferential rim and retainable by magnetic bonding with said housing.

14. The recessed light assembly of claim 13 wherein said light module is a down light module or an angularly adjustable light module.

15. The recessed light assembly of claim 13 wherein said trim is an assembly selected from a group consisting of a square border with a down light lens, a square border with an angled lens, a circular border with a down light lens and a circular border with an angled lens.

16. A recessed light assembly installation comprising:

a ceiling having a lower surface and an upper surface and defining a ceiling opening extending from said lower surface to said upper surface;

a frame having a panel disposed on said upper surface and a pair of clips mounted to said panel;

a mounting ring supported on said panel and secured thereto by said clamps and defining angularly spaced bores and generally aligned with said ceiling opening;

a ceiling collar comprising a sleeve and having a circumferential rim with a pair of threaded fasteners secured in said bores and cooperatively clamping the collar to said ring so that the ring clamps against the upper surface and the rim clamps against the lower surface, said sleeve mounting a pair of inwardly biased clamps and defining an access opening coaxial with said ceiling opening, said ceiling collar and said mounting ring; and a light module comprising a housing having means defining a pair of slots engaged by said clamps to releasably support said light module at a fixed angular position relative to said ceiling collar in recessed relationship relative to said ceiling.

17. The recessed light assembly installation of claim 16 further comprising a mud ring mounted over said circumferential rim and engaging the ceiling and at least two fasteners extending through the mud ring and the ceiling and engaging with the mounting ring.

18. The recessed light installation of claim 17 and further comprising a trim assembly mounted over said mud ring and releasably retainable with said housing.

19. The recessed light assembly installation of claim 16 wherein said light module is a down light module or an angularly adjustable light module.

20. The recessed light assembly installation of claim 16 wherein said trim assembly is selected from the group consisting of a square flange with a down light lens, a square flange with an angled lens, a round flange with a down light lens and a square flange with an angled lens.

* * * * *